US011506388B1

(12) United States Patent
Boardman et al.

(10) Patent No.: US 11,506,388 B1
(45) Date of Patent: Nov. 22, 2022

(54) FURCATING PILOT PRE-MIXER FOR MAIN MINI-MIXER ARRAY IN A GAS TURBINE ENGINE

(71) Applicant: General Electric Company, Schenectady, NY (US)

(72) Inventors: Gregory A. Boardman, Owens Cross Roads, AL (US); Pradeep Naik, Karnataka (IN); Bassam Sabry Mohammad Abdelnabi, Guilderland, NY (US); Manampathy G. Giridharan, Mason, OH (US); Vishal Sanjay Kediya, Karnataka (IN); Narasimhan S. Sahana, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/315,016

(22) Filed: May 7, 2021

(51) Int. Cl.
*F23R 3/34* (2006.01)
*F23R 3/28* (2006.01)

(52) U.S. Cl.
CPC ..... *F23R 3/343* (2013.01); *F23R 3/286* (2013.01); *F23D 2900/00014* (2013.01)

(58) Field of Classification Search
CPC .. F23R 3/28; F23R 3/283; F23R 3/286; F23R 3/34; F23R 3/343; F23R 3/346
See application file for complete search history.

(56) References Cited

U.S. PATENT DOCUMENTS

| | | | | |
|---|---|---|---|---|
| 5,941,698 | A | 8/1999 | Darling et al. | |
| 6,427,930 | B1 * | 8/2002 | Mei | F23R 3/286 239/419 |
| 6,594,999 | B2 | 7/2003 | Mandai et al. | |
| 7,520,134 | B2 | 4/2009 | Durbin et al. | |
| 7,665,308 | B2 | 2/2010 | Durbin et al. | |
| 8,276,385 | B2 | 10/2012 | Zuo et al. | |
| 8,322,143 | B2 | 12/2012 | Uhm et al. | |
| 8,371,125 | B2 | 2/2013 | Miura et al. | |
| 8,424,311 | B2 | 4/2013 | York et al. | |
| 8,539,773 | B2 | 9/2013 | Ziminsky et al. | |
| 9,134,023 | B2 | 9/2015 | Boardman et al. | |
| 9,625,157 | B2 | 4/2017 | Melton et al. | |
| 10,295,190 | B2 | 5/2019 | Boardman et al. | |
| 10,352,568 | B2 | 7/2019 | Eroglu et al. | |
| 10,352,569 | B2 | 7/2019 | Boardman et al. | |
| 10,502,425 | B2 | 12/2019 | Boardman et al. | |
| 2004/0255589 | A1 * | 12/2004 | Yoshida | F23R 3/343 60/746 |

(Continued)

*Primary Examiner* — William H Rodriguez
(74) *Attorney, Agent, or Firm* — Venable LLP; Edward A. Kmett; Michele V. Frank

(57) ABSTRACT

A pilot pre-mixer for a gas turbine engine has a pilot body that includes an internal mixing chamber, a first end on an upstream side of the internal mixing chamber, a second end on a downstream side of the internal mixing chamber, a fuel injector at the first end and communicable with the internal mixing chamber, a plurality of first oxidizer inlet ports arranged to provide an oxidizer agent from outside of the pilot body to the internal mixing chamber, and a plurality of pilot outlet ports at the second end and communicable with the internal mixing chamber, each of the plurality of pilot outlet ports having an outlet on the second end for dispensing a pilot fluid mixture into a combustion zone of a combustor.

20 Claims, 10 Drawing Sheets

(56) References Cited

U.S. PATENT DOCUMENTS

| | | | | |
|---|---|---|---|---|
| 2014/0260299 | A1* | 9/2014 | Boardman | F23R 3/286 60/737 |
| 2014/0260315 | A1* | 9/2014 | Westmoreland | F23R 3/286 60/737 |
| 2014/0283522 | A1* | 9/2014 | Boardman | F23R 3/286 60/737 |
| 2016/0186662 | A1* | 6/2016 | Stewart | F23R 3/14 239/403 |
| 2016/0186663 | A1* | 6/2016 | Stewart | F23R 3/286 60/737 |
| 2017/0089582 | A1* | 3/2017 | Garrotte | F23R 3/343 |
| 2018/0128492 | A1* | 5/2018 | Boardman | F23R 3/14 |
| 2018/0298824 | A1* | 10/2018 | Matsuyama | F23R 3/28 |
| 2019/0032559 | A1* | 1/2019 | Dai | F23R 3/26 |
| 2019/0186749 | A1* | 6/2019 | Harper | F23D 14/58 |
| 2019/0195498 | A1 | 6/2019 | Prociw et al. | |
| 2020/0025385 | A1 | 1/2020 | Boardman et al. | |

* cited by examiner

FURCATING PILOT PRE-MIXER FOR MAIN MINI-MIXER ARRAY IN A GAS TURBINE ENGINE

TECHNICAL FIELD

The present disclosure relates to a pilot fuel-air pre-mixer for a gas turbine engine. More particularly, the disclosure relates to a furcating pilot pre-mixer for a main mini-mixer array that provides a plurality of outlet ports for outputting a fuel-air mixture to a combustor of a gas turbine engine.

BACKGROUND

Gas turbine engines have been employed in a variety of applications, including aircraft, marine and industrial applications such as in the oil and gas industry. Various emissions standards have been set by government agencies and gas turbine engine vendors have strived to improve the emissions of their products to meet the standards. One technology employed in gas turbine engines has been known as Dry Low Emissions (DLE) combustors. DLE combustors generally utilize a pre-mixer assembly to pre-mix fuel and air prior to the fuel-air mixture being ejected into a combustion section for ignition. Conventional, pre-mixer assemblies have been known to include both pilot pre-mixers and main pre-mixers. Pilot pre-mixers generally mix fuel and air to a desired ratio that is ejected into the combustion chamber for use during engine start-up, and lower power operations, but is also continuously ejected during all operation modes. Main pre-mixers, on the other hand, generally mix fuel and air to produce a lean fuel-air mixture that is ejected into the combustion chamber across power operations. Generally, only some of the main pre-mixers are fueled at lower power conditions, while all of the main pre-mixers are fueled at higher power conditions. When a flame is ignited for the pilot mixture, combustion products from the pilot provide an ignition source to the main pre-mixer flames to achieve combustion within the system.

BRIEF SUMMARY

To address problems in the conventional art, the present inventors have devised techniques for providing a furcating pilot flame into the combustor so as to provide better spread of the pilot fuel-air mixture to the main pre-mixers. According to one aspect, the present disclosure is directed to a pre-mixer assembly for a gas turbine engine. The pre-mixer assembly includes a housing having a combustion chamber side and a pre-mixer side, a plurality of main pre-mixers connected to the housing, each main pre-mixer having an outlet on the combustion chamber side of the housing for dispensing a main pre-mixer fluid mixture to a combustion chamber of a combustor, and at least one pilot pre-mixer connected to the housing. In addition, each pilot pre-mixer includes a pilot body, including: an internal mixing chamber; a first end on an upstream side of the internal mixing chamber; a second end on a downstream side of the internal mixing chamber; a fuel injector at the first end and communicable with the internal mixing chamber; a plurality of first oxidizer inlet ports arranged to provide an oxidizer agent from outside of the pilot body to the internal mixing chamber; and a plurality of pilot outlet ports at the second end and communicable with the internal mixing chamber, each of the plurality of pilot outlet ports having an outlet on the second end for dispensing a pilot fluid mixture into the combustion zone of the combustor.

According to another aspect, the present disclosure is directed to a pilot pre-mixer for a gas turbine engine, comprising: a pilot body, including: an internal mixing chamber; a first end on an upstream side of the internal mixing chamber; a second end on a downstream side of the internal mixing chamber; a fuel injector at the first end and communicable with the internal mixing chamber; a plurality of first oxidizer inlet ports arranged to provide an oxidizer agent from outside of the pilot body to the internal mixing chamber; and a plurality of pilot outlet ports at the second end and communicable with the internal mixing chamber, each of the plurality of pilot outlet ports having an outlet on the second end for dispensing a pilot fluid mixture into a combustion zone of a combustor.

Additional features, advantages, and embodiments of the present disclosure are set forth or apparent from consideration of the following detailed description, drawings and claims. Moreover, it is to be understood that both the foregoing summary and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
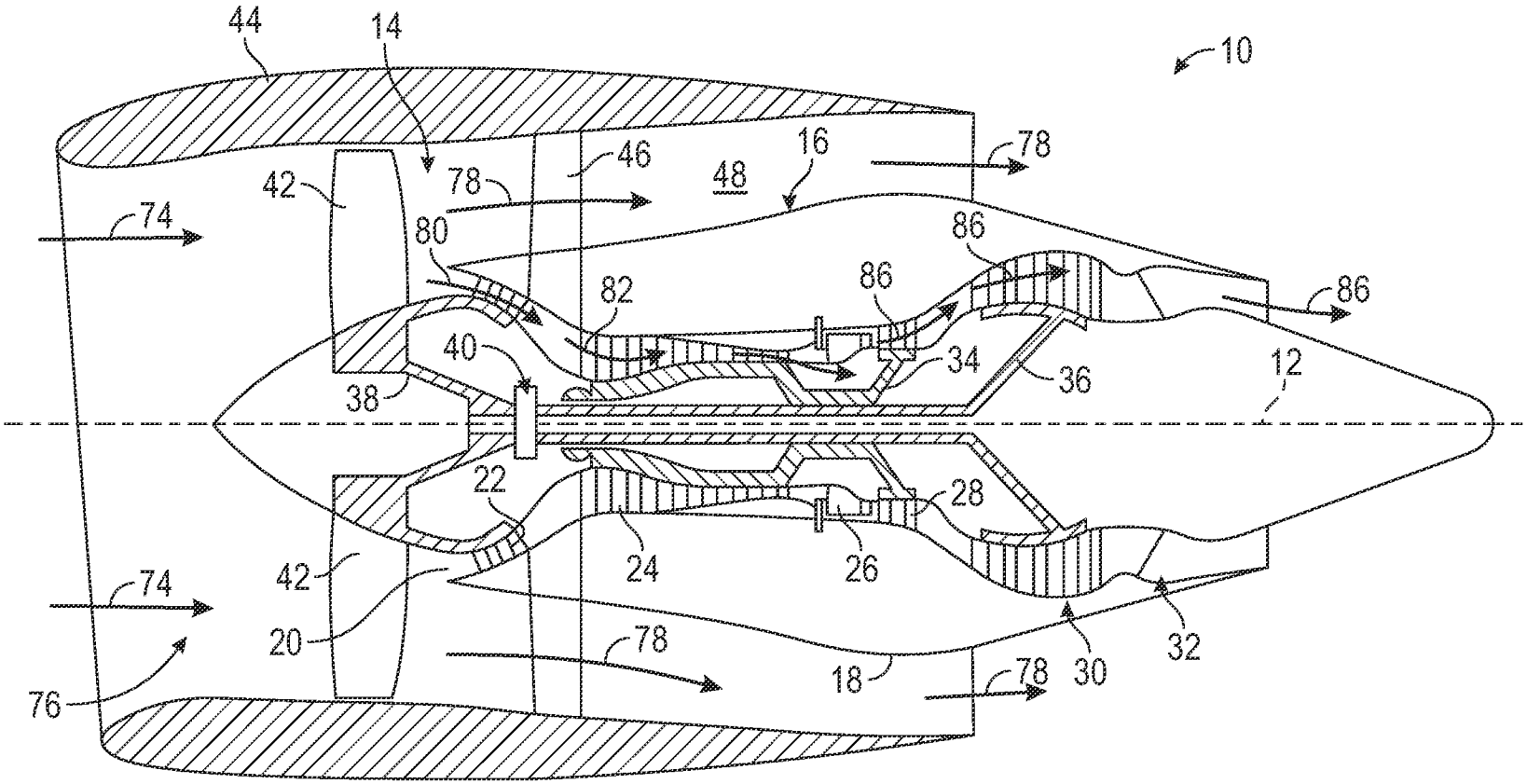
FIG. 1 is a schematic partially cross-sectioned side view of an exemplary high by-pass turbofan jet engine, according to an embodiment of the present disclosure.

Various embodiments are discussed in detail below. While specific embodiments are discussed, this is done for illustration purposes only. A person skilled in the relevant art will recognize that other components and configurations may be used without departing from the spirit and scope of the present disclosure.

Generally, conventional pilot pre-mixers include a single outlet port that produces a centralized flame directed straight from the pre-mixer outlet. With this arrangement, combustion products from the pilot are not efficiently mixed with the main pre-mixer mixture and the centralized pilot flame does not provide sufficient stability of the main pre-mixer flame. Additionally, a rich fuel-air mixture from the pilot remains in the centerline of the pilot and does not efficiently mix with the main pre-mixer fuel-air mixture. This results in higher NOx (Nitrogen Oxides) emissions. Thus, there exists a need to provide better stability to the main pre-mixer flame to ensure lower NOx emissions. The present disclosure addresses these problems by providing techniques for a better spread of the pilot fuel-air mixture towards the main pre-mixers inside the combustion chamber for more efficient burning.

The present disclosure generally relates to a pre-mixer assembly for use in, for example, a Dry Low Emissions (DLE) type combustor of a gas turbine engine. More particular, the disclosure generally relates to a pilot pre-mixer that provides a pre-mixed fuel-air mixture to a combustion chamber in a manner that directs the flow of the fuel-air mixture closer to main pre-mixers than with the conventional pilot pre-mixer. In the present disclosure, a pilot pre-mixer has a fuel injector to which a fuel input thereto is injected into a mixing chamber of the pilot pre-mixer, and also has air inlet ports that provide air from outside of the pilot pre-mixer into the mixing chamber to mix with the fuel. The fuel injector is generally conical shaped and ejects the fuel from a tip thereof. The air inlet ports are arranged such that some of them are located upstream of the fuel injector tip. Others of the air inlet ports are arranged with their center aligned with the tip of the fuel injector. With this arrangement, the air from the air inlet ports impinge on the fuel being ejected from the tip to prevent a low velocity at the tip, and also provide an outward flow of the fuel-air mixture at the tip toward an outer wall of the mixing chamber. Thus, a more efficient mixing of the fuel and air can be obtained without the need for internal swirlers in the mixing chamber.

The fuel and air mixture continues to be further mixed in the mixing chamber as it travels downstream, possibly with additional air from additional air inlet ports, until it reaches a plurality of outlet ports formed at a downstream end of the pilot pre-mixer. The plurality of outlet ports divide the fuel-air mixture into branches where it continues to be mixed within a channel of the outlet ports. The outlet ports are arranged at a radially outward angle so as to provide the fuel-air mixture away from a center of the pilot pre-mixer. The pilot fuel-air mixture is then ejected from the outlet ports into the combustion chamber for ignition.

In operation, at start-up and low power operations, the fuel-air mixture from the pilot only may be ignited, whereas at other operating conditions, a fuel-air mixture may also be ejected from main pre-mixers that are also part of the pre-mixer assembly. The fuel-air mixture from the main pre-mixers is generally ignited by a flame from the already burning pilot pre-mixer fuel-air mixture. To obtain a more stable flame for the main pre-mixers, the outlets of the pilot pre-mixer are arranged at the radial angle so as to disperse the pilot fuel-air mixture in close proximity to one or more of the main pre-mixers. This is in contrast to prior art systems in which the pilot fuel-air mixture is not directed towards the main pre-mixers, but is generally directed straight into the combustion chamber.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Referring now to the drawings, FIG. 1 is a schematic partially cross-sectioned side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal or axial centerline axis 12 that extends there through for reference purposes. In general, engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, although not illustrated, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16.

In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
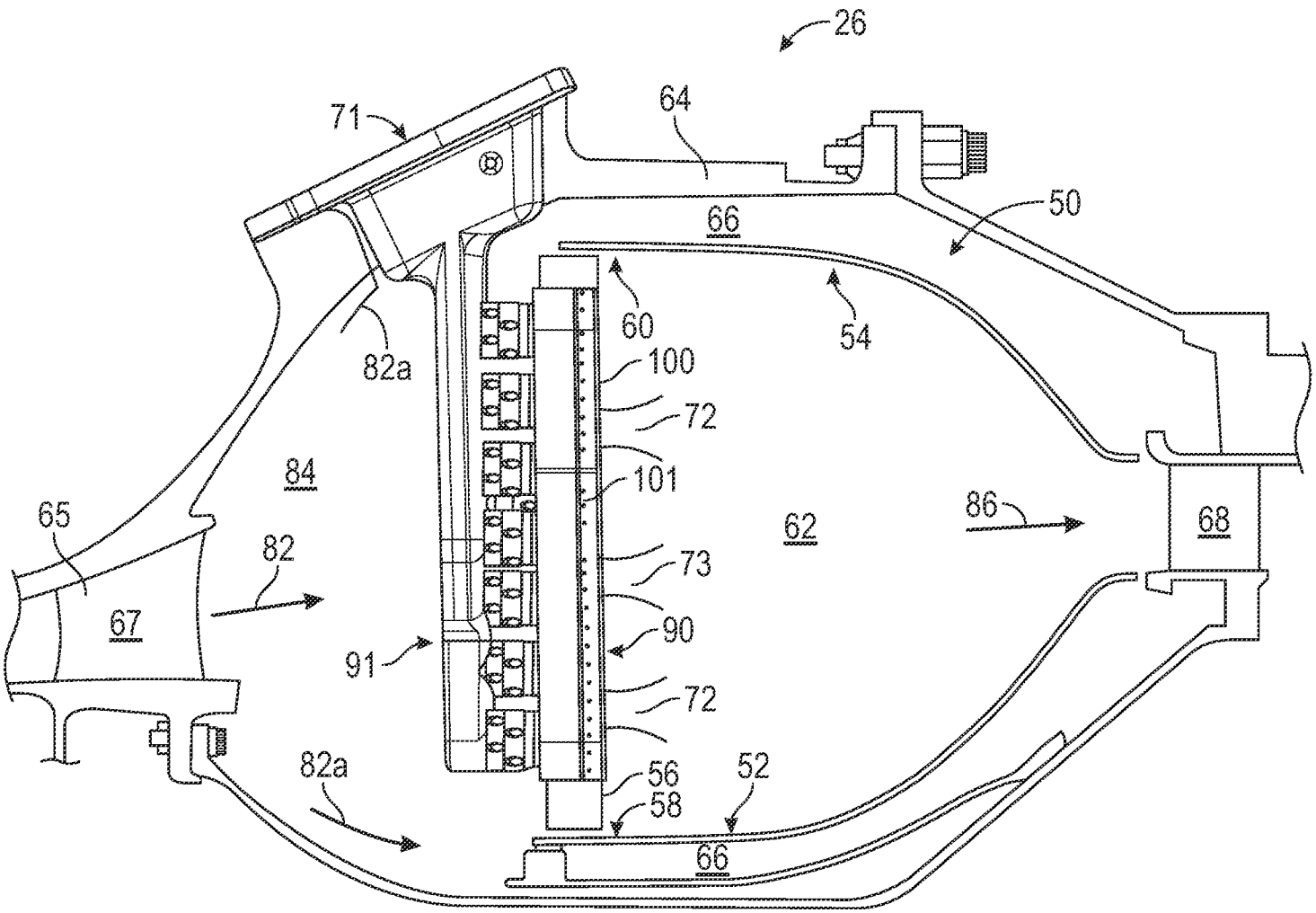
FIG. 2 is a partial cross-sectional side view of an exemplary combustion section, according to an embodiment of the present disclosure.

FIG. 2 is a cross sectional side view of an exemplary combustion section 26 of the core engine 16 as shown in FIG. 1. As shown in FIG. 2, the combustion section 26 may generally include an annular type combustor assembly 50 having an annular inner liner 52, an annular outer liner 54 and a bulkhead 56 that extends radially between upstream ends 58, 60 of the inner liner 52 and the outer liner 54 respectfully. As shown in FIG. 2, the inner liner 52 is radially spaced from the outer liner 54 with respect to engine centerline axis 12 (FIG. 1) and defines a generally annular combustion chamber 62 therebetween. In particular embodiments, the inner liner 52 and/or the outer liner 54 may be at least partially or entirely formed from metal alloys or ceramic matrix composite (CMC) materials.

As shown in FIG. 2, the inner liner 52 and the outer liner 54 may be encased within an outer casing 64. An outer flow passage 66 may be defined around the inner liner 52 and/or the outer liner 54. The inner liner 52 and the outer liner 54 may extend from the bulkhead 56 towards a turbine nozzle or inlet 68 to the HP turbine 28 (FIG. 1), thus at least partially defining a hot gas path between the combustor assembly 50 and the HP turbine 28. A pre-mixer assembly 100 may extend at least partially through the bulkhead 56 and provide a main mixer fuel-air mixture 72 to the combustion chamber 62, as well as a pilot pre-mixer fuel-air mixture 73 to the combustion chamber 62.

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42, a portion of the air as indicated schematically by arrows 78 is directed or routed into the bypass airflow passage 48, while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows across a compressor exit guide vane (CEGV) 67 and through a pre-diffuser 65 into a diffuser cavity 84 of the combustion section 26.

The pre-diffuser 65 and CEGV 67 condition the flow of compressed air 82 to the pre-mixer assembly 100. The compressed air 82 pressurizes the diffuser cavity 84. The compressed air 82 enters the pre-mixer assembly 100 and, as will be discussed below, into a plurality of main pre-mixers 102 and a plurality of pilot pre-mixers 104 within the pre-mixer assembly 100 to mix with a fuel 71. As will be described in more detail below, the main pre-mixers 102 and the pilot pre-mixers 104 are retained by a housing 101 and pre-mix fuel 71 and compressed air 82 within an array of main pre-mixers 102 and pilot pre-mixers 104 to provide a resulting main pre-mixer fluid (fuel/air) mixture 72 and a pilot pre-mixer fluid (fuel/air) mixture 73 respectively, exiting from the pre-mixer assembly 100 into combustion chamber 62. The fuel-air mixtures 72, 73 are then ignited and burned within the combustion chamber 62 and generate combustion gases 86.

Typically, the LP and HP compressors 22, 24 provide more compressed air to the diffuser cavity 84 than is needed for combustion. Therefore, a second portion of the compressed air 82 as indicated schematically by arrows 82(*a*) may be used for various purposes other than combustion. For example, as shown in FIG. 2, compressed air 82(*a*) may be routed into the outer flow passage 66 to provide cooling to the inner and outer liners 52, 54. In addition or in the alternative, at least a portion of compressed air 82(*a*) may be routed out of the diffuser cavity 84. For example, a portion of compressed air 82(*a*) may be directed through various flow passages to provide cooling air to at least one of the HP turbine 28 or the LP turbine 30.

Referring back to FIGS. 1 and 2 collectively, the combustion gases 86 generated in the combustion chamber 62 flow from the combustor assembly 50 into the HP turbine 28 via inlet 68, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

Figure 3B:
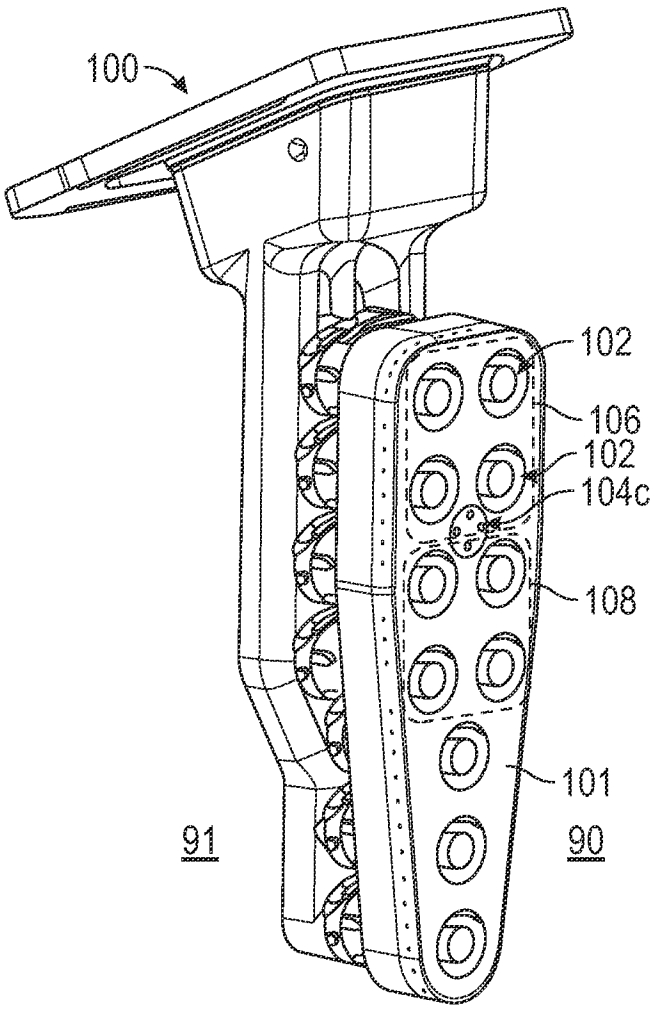
FIG. 3B depicts a perspective view of another exemplary pre-mixer assembly, according to an embodiment of the present disclosure.
Figure 3A:
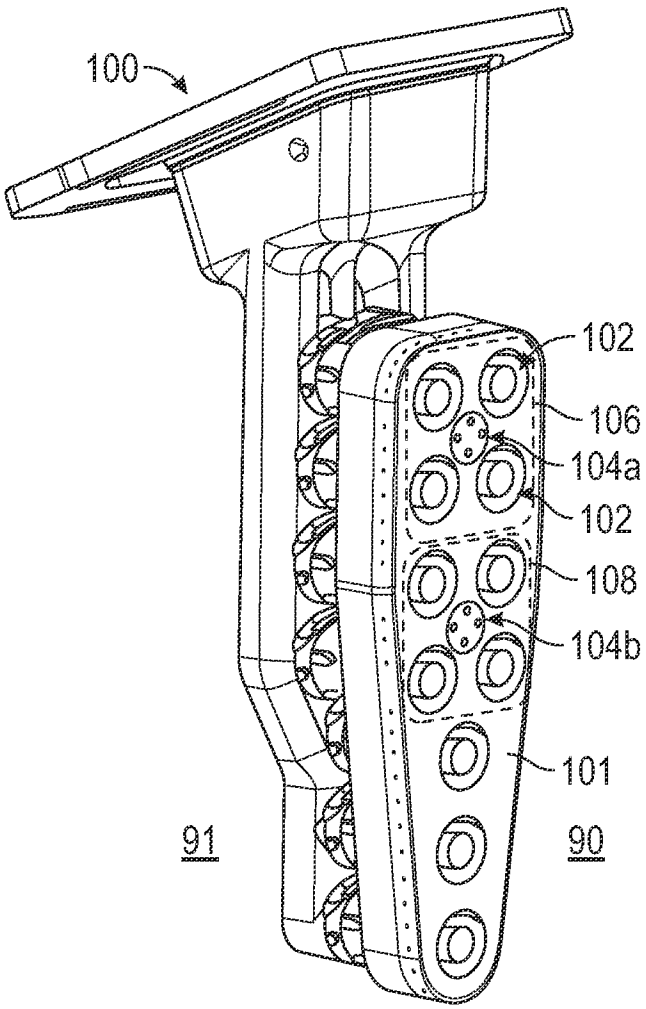
FIG. 3A depicts a perspective view of an exemplary pre-mixer assembly, according to the present disclosure.

Referring now to FIGS. 3A and 3B, depicted therein are perspective views of an exemplary pre-mixer assembly 100 according to the present disclosure. In FIG. 3A, pre-mixer assembly 100 is seen to include a housing 101 that retains a plurality of main pre-mixers 102 and a plurality of pilot pre-mixers 104 (e.g., 104*a*, 104*b*, 104*c*). The pre-mixer assembly 100 includes a combustion chamber side 90 from which a fuel-air mixture is ejected from the pre-mixer assembly 100 and a pre-mixer side 91 in which fuel and air are introduced in the pre-mixer assembly 100. As is commonly known in DLE combustors, the pilot pre-mixers provide a fuel-air mixture 73 to the combustion chamber for burning generally at start-up and low power operations, and the main pre-mixers provide a lean fuel-air mixture 72 to the combustion chamber for burning at higher power operations. The main pre-mixers 102 are generally ignited via a flame that is already burning the pilot pre-mixer fuel/air mixture. As will be discussed in more detail below, but as seen in FIG. 3A, a first array 106 of four main pre-mixers 102 may be included with a first pilot pre-mixer 104*a* centrally located within the first array 106. Similarly, a second array 108 of four main-pre-mixers 102 may be included with a second pilot pre-mixer 104*b* centrally located within the second array 108. Alternatively, as seen in FIG. 3B, a pilot pre-mixer 104*c* may be located between the first array 106 and the second array 108 of main pre-mixers 102.

Figure 4:
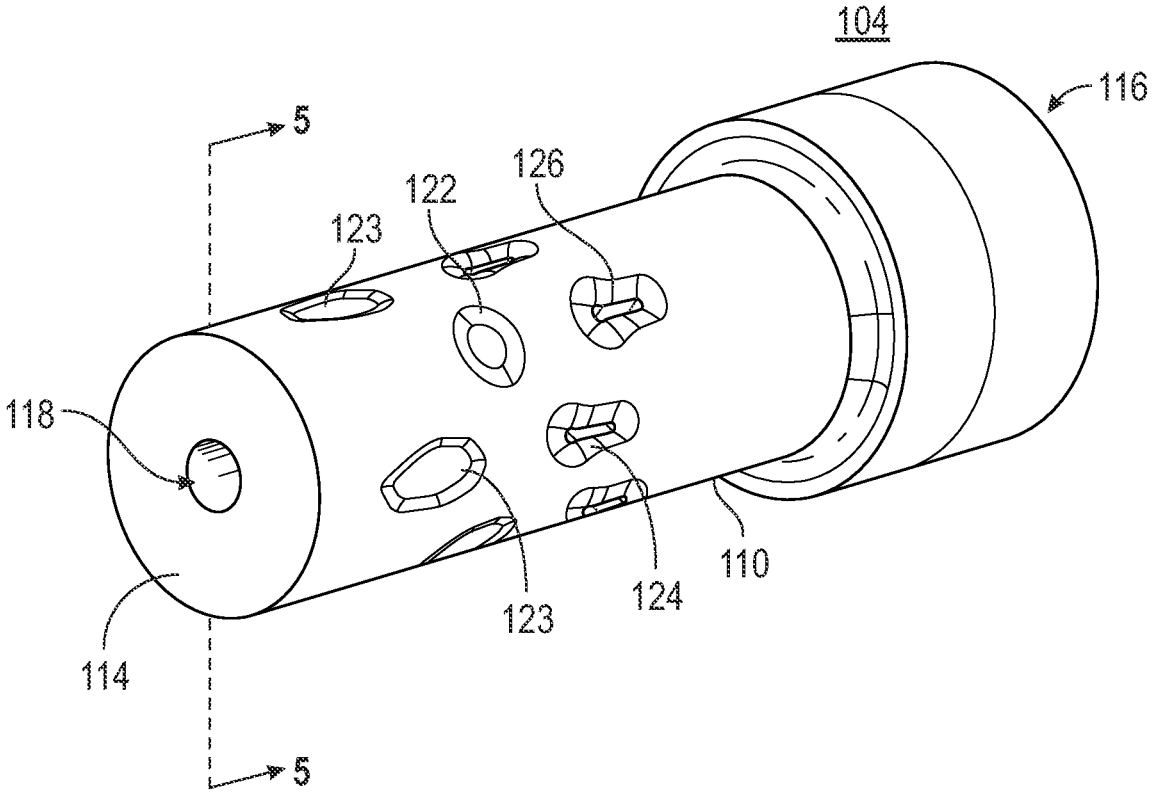
FIG. 4 is a perspective view of a pilot pre-mixer, according to an embodiment of the present disclosure.
Figure 5:
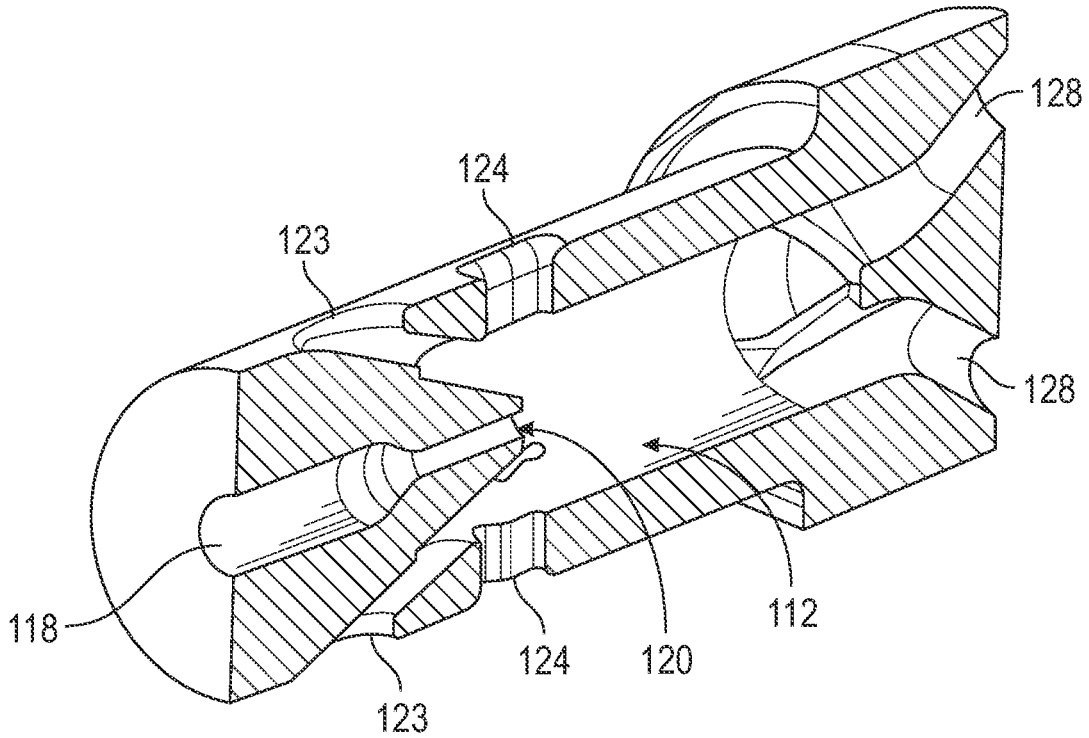
FIG. 5 is a cross sectional view of a pilot pre-mixer taken along line 5-5 in FIG. 4 shown in a perspective view, according to an embodiment of the present disclosure.
Figure 6:
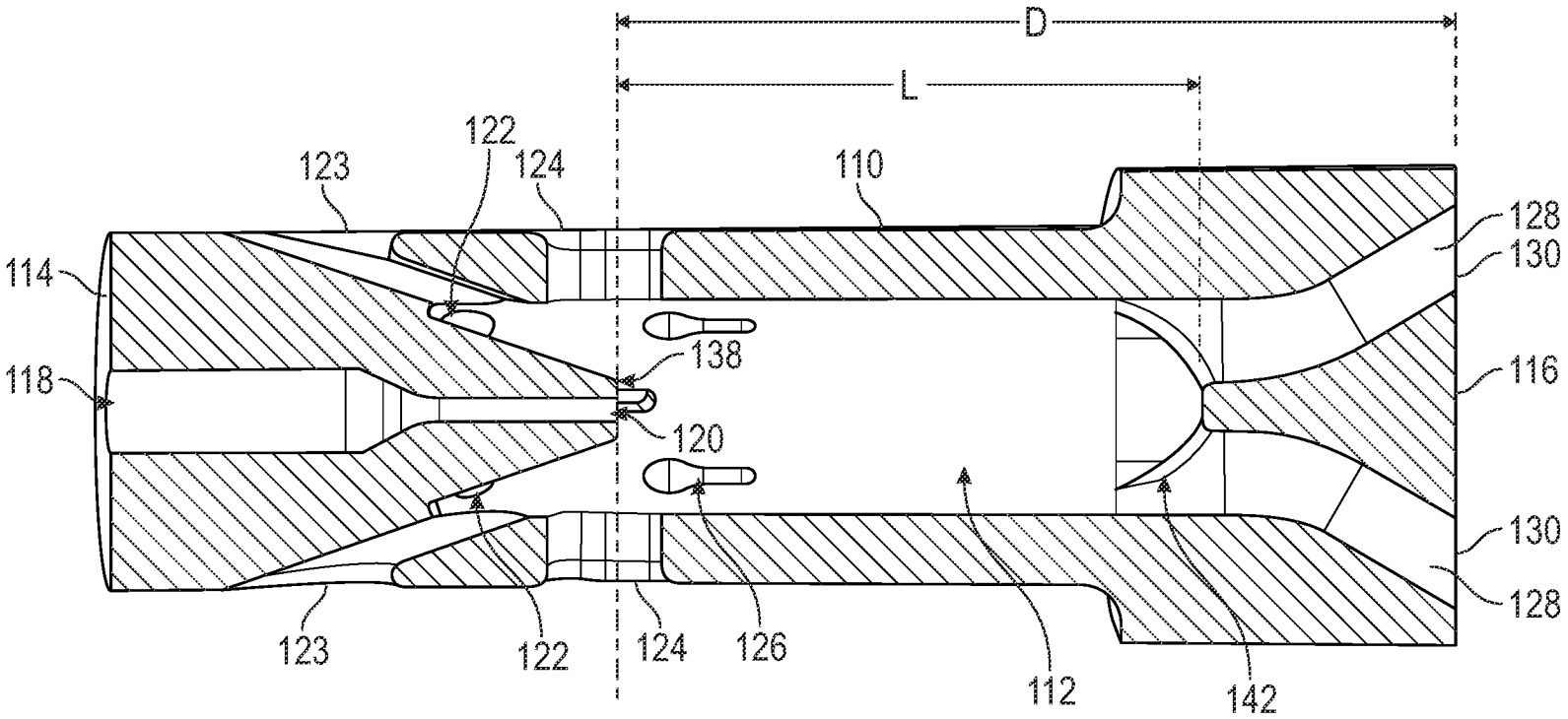
FIG. 6 is another cross-sectional view of a pilot pre-mixer taken along line 5-5 in FIG. 4 shown in a plan view, according to an embodiment of the present disclosure.

Referring to FIGS. 4 to 6, FIG. 4 is a perspective view of a pilot pre-mixer 104, FIG. 5 is a perspective cross sectional view along plane 5-5 shown in FIG. 4, and FIG. 6 is a plan cross sectional view along plane 5-5. As seen in these figures, the pilot pre-mixer 104 includes a pilot body 110 that has formed therein an internal mixing chamber 112. In operation, a flow of a fuel-air mixture within the pilot body is from left (upstream) to right (downstream) in FIG. 6. Thus, the pilot body 110 includes a first end 114 on an upstream side of the internal mixing chamber 112, and a second end 116 on a downstream side of the internal mixing chamber 112. A fuel injector 118 is included at the first end 114 and is communicable with the internal mixing chamber 112 via a fuel outlet port 120 to provide fuel to the internal mixing chamber 112.

The pilot body 110 further includes a plurality of first oxidizer inlet ports (air holes) 122 arranged to provide an oxidizer agent (e.g. air) from outside of the pilot body 110 to the internal mixing chamber 112. As will be described in more detail below, pilot body 110 includes a plurality of second oxidizer inlet ports 123 located in the body upstream of the first oxidizer inlet ports 122. In exemplary embodiments, the pilot body 110 may further include a plurality of third oxidizer inlet ports 124 downstream of the first oxidizer inlet ports 122, and a plurality of fourth oxidizer inlet ports 126 downstream of the second oxidizer inlet ports 123. As will be described in more detail below, these respective oxidizer inlet ports 123, 122, 124 and 126 provide for first, second, third and fourth stages of air flow into the pre-mixture. Of course, the number of stages and the number of oxidizer inlet port (air holes) is not limited to those shown in exemplary embodiments described herein, and the number of stages and/or oxidizer inlets per stage, if any, may vary depending on a desired fuel-air mixture to be obtained within the pilot pre-mixer 104.

Referring again to FIGS. 4 to 6, pilot body 110 is seen to include a plurality of pilot outlet ports 128 at the second end 116. The pilot outlet ports 128 are communicable with the internal mixing chamber 112, and each of the plurality of pilot outlet ports 128 has an outlet 130 on the combustion chamber side 90 of the housing 101 for dispensing a pilot fuel-air mixture 73 into the combustion chamber 62 of the combustor.

In FIG. 6, commencement of the pilot outlet ports 128 lengthwise along the pilot (i.e., a point where furcation begins), may be a distance L from a tip 138 of the fuel outlet port 120. In various embodiments, the length L may be between 30% to 90% of a length D taken from the tip 138 of the fuel outlet port 120 to a surface of the downstream end 116 where outlets 130 are located. In the exemplary embodiment shown in FIG. 6, the length L can be seen to be about 70% of the length D.

Figure 10:
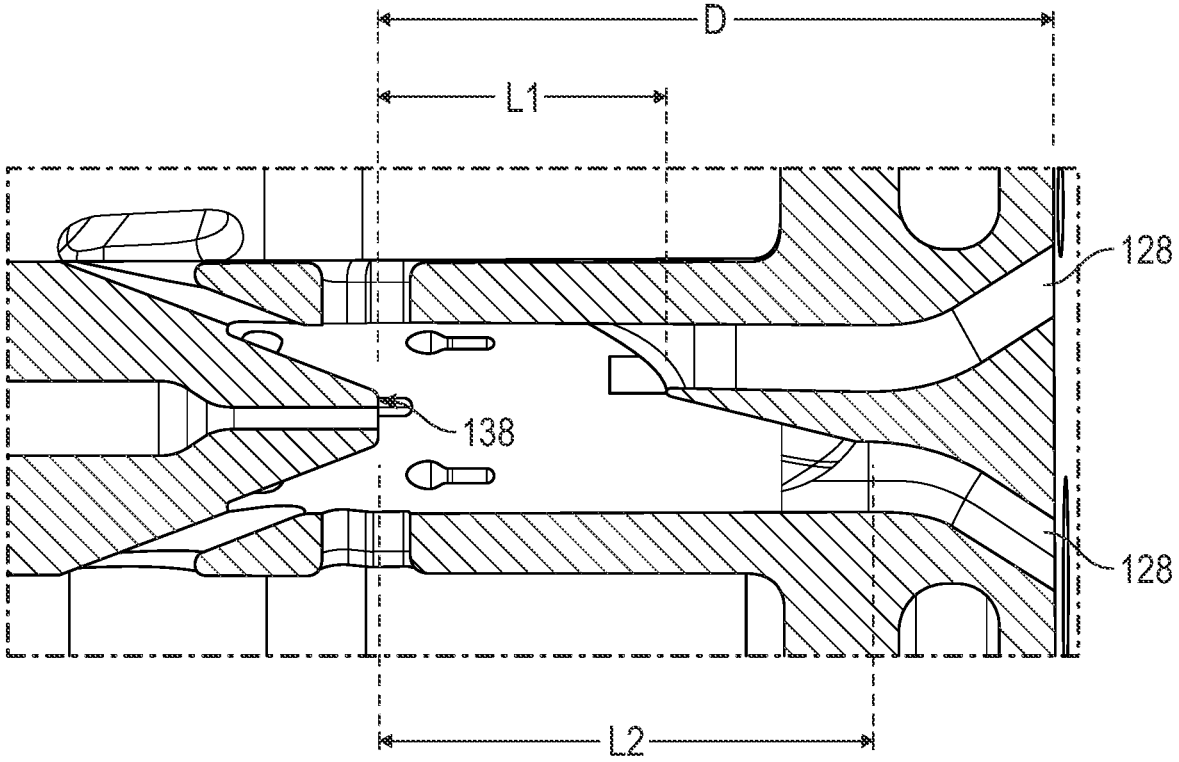
FIG. 10 is a partial cross-sectional view of a pilot with different length outlets, according to an embodiment of the present disclosure.

In FIG. 6, the length L is depicted as being the same for each of the pilot outlet ports 128. However, in another exemplary embodiment shown in FIG. 10, the length L may be different for individual ones of the pilot outlet ports 128. In FIG. 10, it can be seen that some of the pilot outlet ports 128 may commence at a first length $L_1$, while others of the pilot outlet ports 128 may commence at a second length $L_2$, where $L_1<L_2$. Thus, some of the pilot outlet ports 128 may have a longer channel length than others so as to provide for different fuel-air ratio mixtures to different main mixers.

Figure 7:
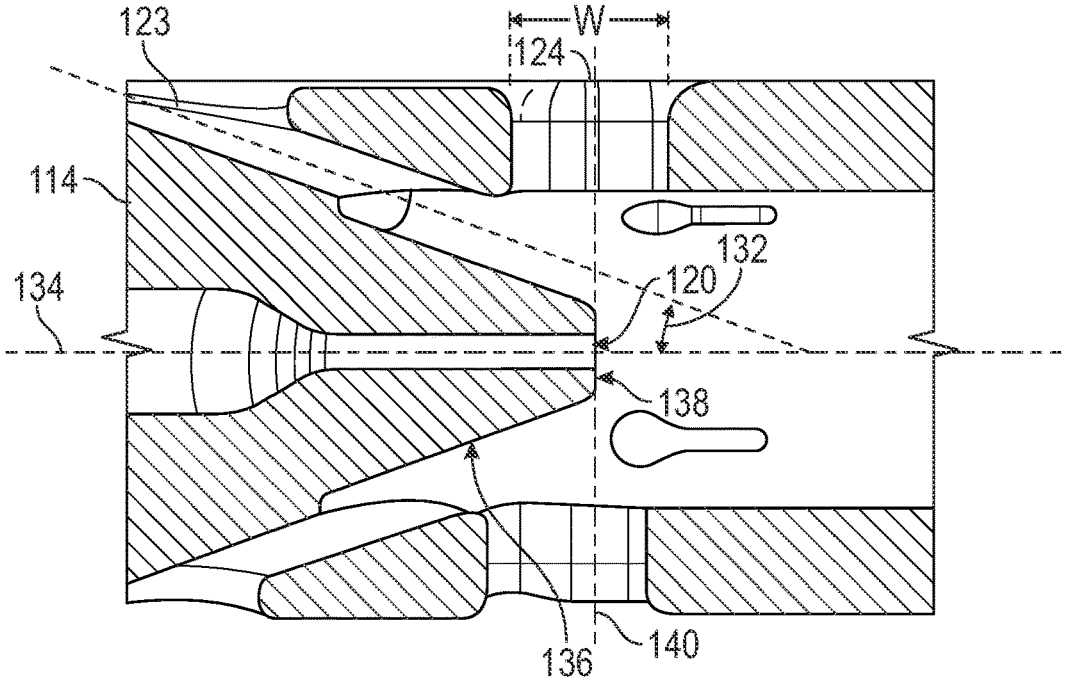
FIG. 7 depicts an enlarged view of an upstream end of a pilot pre-mixer, according to an embodiment of the present disclosure.

Referring now to FIG. 7, depicted therein is an enlarged view of an exemplary embodiment depicting an arrangement of the fuel injector 118, the fuel outlet port 120 into the internal mixing chamber 112 and the oxidizer inlet ports 123. As seen in the figure, the plurality of oxidizer inlet ports 123 are arranged upstream of the oxidizer inlet ports 124 (see FIG. 4) and are arranged at an angle 132 extending radially inward toward a centerline axis 134 of the internal mixing chamber 112 from the upstream end 114 toward the downstream end 116. In one preferable embodiment, the angle 132 may be about 30 degrees, while in other exemplary embodiments, the angle 132 may range from 10 to <90 degrees.

As seen in FIG. 7, the fuel injector 118 has a conical shaped outer surface 136 with a truncated apex thereof forming a fuel nozzle tip 138 extending into the internal mixing chamber 112 toward the downstream end 116. The fuel outlet port 120 is arranged through the tip 138. Fuel is fed to the fuel injector 118 by a not shown fuel supply line, and is output into the internal mixing chamber 112 via the fuel outlet port 120. In FIG. 7, at least a portion of each of the oxidizer inlet ports 123 is arranged at an angle to provide a flow of the oxidizer along the conical shaped outer surface 136 of the fuel injector 118 so as to impinge the oxidizer flow (i.e., the flow of air through the oxidizer inlet ports 123) on a flow of fuel ejected from the fuel outlet port 120. In this manner, an air jet is provided to accelerate the fuel ejected from the fuel outlet port 120 into the internal mixing chamber, which aids in the prevention of low velocity in the fuel injection area.

Referring again to FIG. 7, in one exemplary embodiment, a centerline axis 140 of oxidizer inlet ports 124 is seen to be aligned with the fuel nozzle tip 138. In this manner, oxidizer (air) flow entering through the ports 124 also helps to avoid low velocity at the fuel injector tip. The interaction of the oxidizer from oxidizer inlet ports 123 and the oxidizer from oxidizer inlet ports 124 impinge on one another and on the tip 138 of fuel injector and cause the air flow and the fuel ejected from the fuel outlet port 120 to turn outward towards the wall of the internal mixing chamber 112. This helps to provide a better radial spread of the fuel in the internal mixing chamber 112 without the need for swirlers inside the pilot body.

In FIGS. 4 to 7, oxidizer inlet ports 124 can be seen to generally include both a cylindrical portion and a slotted portion forming the inlet port 124. However, it can be understood that the oxidizer inlet ports 123 may be any other shape, including merely being a cylindrical hole. Regardless of the shape of the oxidizer inlet port 123, a centerline of the inlet port to be aligned with the tip 138 constitutes a median of a width W of the inlet port in a horizontal (i.e., upstream to downstream) direction.

Additionally, in the figures, oxidizer inlet ports 122, 124 and 126 are generally shown as being perpendicular to centerline axis 134. However, in other embodiments, any or all of these oxidizer inlet ports may be angled with respect to the centerline axis 134. For example, some or all of these oxidizer inlet ports may be angled from 10 degrees to 135 degrees with respect to the centerline axis 134, where an angle from 10 to 80 degrees would help to reduce wakes from behind the jet flow from the angled inlets and an angle from 80 to 135 degrees would help to increase the turbulence level of the mixture in the internal mixing chamber.

Figure 8:
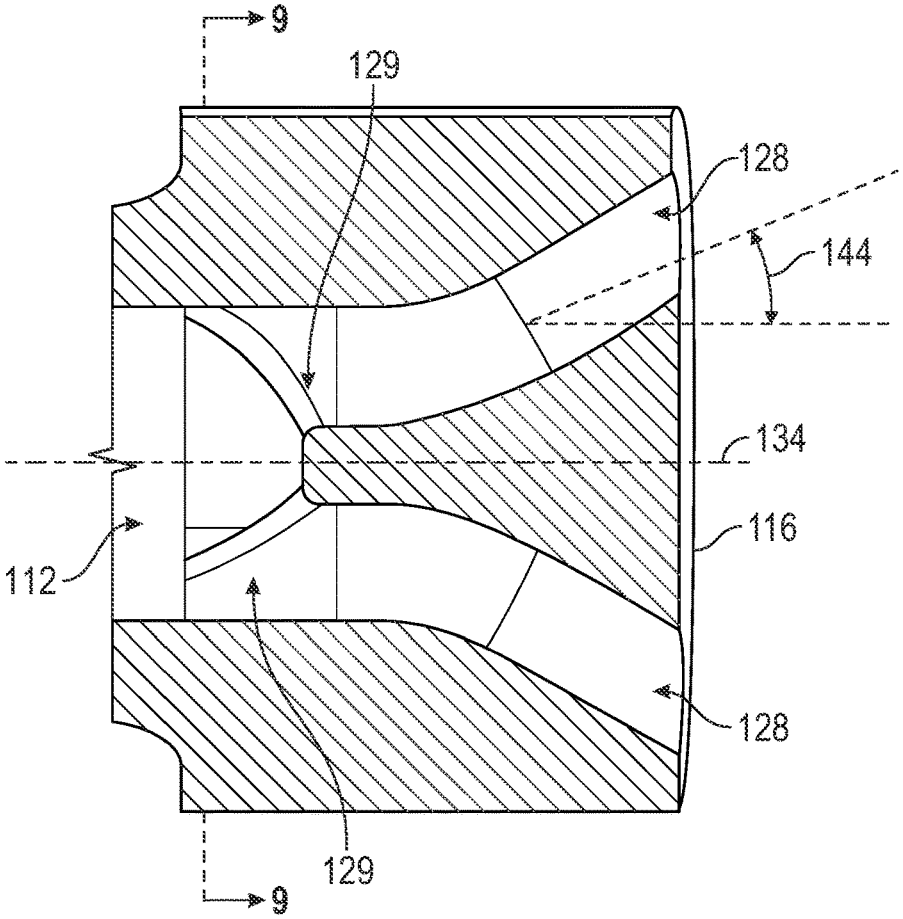
FIG. 8 depicts an enlarged view of a downstream end of a pilot pre-mixer, according to an embodiment of the present disclosure.

FIG. 8 depicts an enlarged view of an exemplary embodiment depicting an arrangement of the pilot outlet ports 128 on the downstream end 116. As seen in the figure, pilot outlet ports 128 are shown to include an angular portion that is angled radially outward toward the downstream end at a desired angle 144. The desired angle can be set based a desired mixture of the pilot fuel-air mixture with the main mixers. In exemplary embodiments, the angle of the angular portion may range from zero to, for example, 70 degrees with respect to the centerline axis 134 of the internal mixing chamber 112. By splitting the internal mixing chamber 112 into multiple pilot outlet ports 128, center peak fuel profiles that otherwise occur in a single outlet of the prior art can be diverted into channels that provide a mixing length for fuel and air mix better. For example, in the prior art system having a single centrally located pilot fuel air mixture, the hottest burn (central peak) occurs far from the main pre-mixer flames. On the other hand, the high temperature burn from the pilot pre-mixer of the present disclosure is located in closer proximity to the main pre-mixer flame. Splitting the flow passages and providing direction to the flow ensures that the pilot fuel-air mixture can be better directed toward the main mixers to provide better stability to the main pre-mixer flames.

Figure 11:
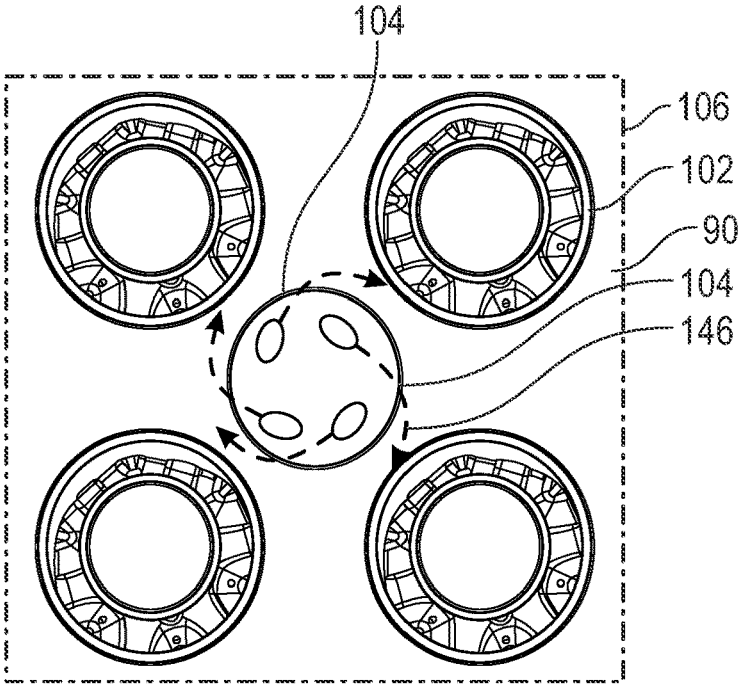
FIG. 11 is a plan view of an arrangement of main pre-mixers and a pilot pre-mixer providing tangential flow, according to an embodiment of the present disclosure.

In another exemplary embodiment (not shown), the pilot outlet ports 128 may be formed in a helical shape extending in the downstream direction from an entrance 129 of the outlet port to the outlet 130. Such an arrangement can provide for greater fuel-air mixing in the pilot outlet port 128 due to its longer length. Additionally, as shown in FIG. 11, the outlets 130 of the pilot pre-mixer 104 may direct the flow of the fuel-air mixture exiting the outlet 130 in a tangential direction 146. This can provide additional mixing downstream between the main mixers and the pilot mixers due to the tangential flow imparted by the helical pilot outlet ports.

Figure 9:
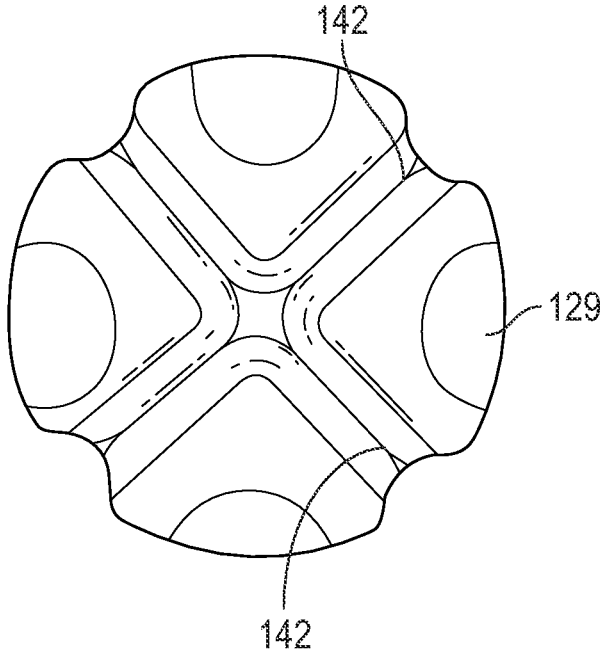
FIG. 9 is a cross-sectional view through a pilot pre-mixer at the outlet ports, according to an embodiment of the present disclosure.

FIG. 9 is a partial cross-sectional view taken along plane 9-9 in FIG. 8 at an entrance 129 to each of the pilot outlet ports 128. As seen in FIG. 9, a divider is formed of a plurality of ribs 142 for dividing the fuel-air mixture flow from the internal mixing chamber 112 into separate flows at the entrance 129 for each of pilot outlet ports 128. FIG. 9 depicts an X-shaped divider including four ribs 142 owing to there being four pilot outlet ports 128 for the particularly depicted embodiment. Of course, the number of ribs dividing the flow of the fuel-air mixture depends on the number of pilot outlet ports 128, which may be more or less than the four depicted in the figure.

Figure 12:
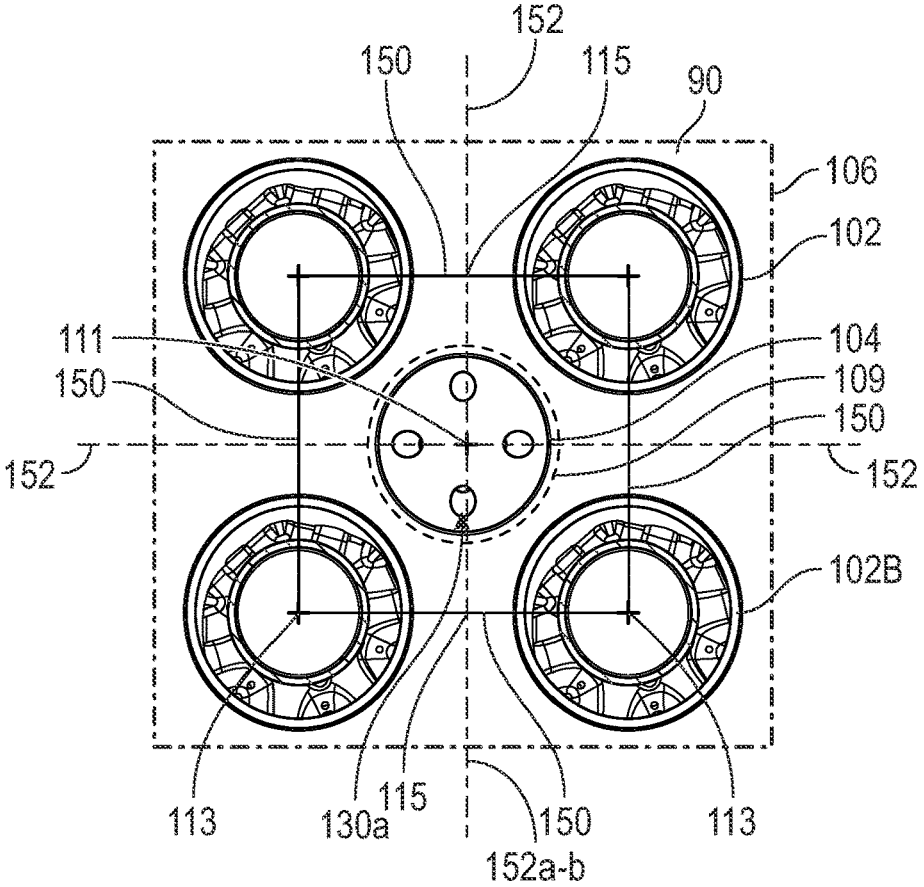
FIG. 12 is a plan view of an arrangement of main pre-mixers and a pilot pre-mixer, according to an embodiment of the present disclosure.
Figure 13:
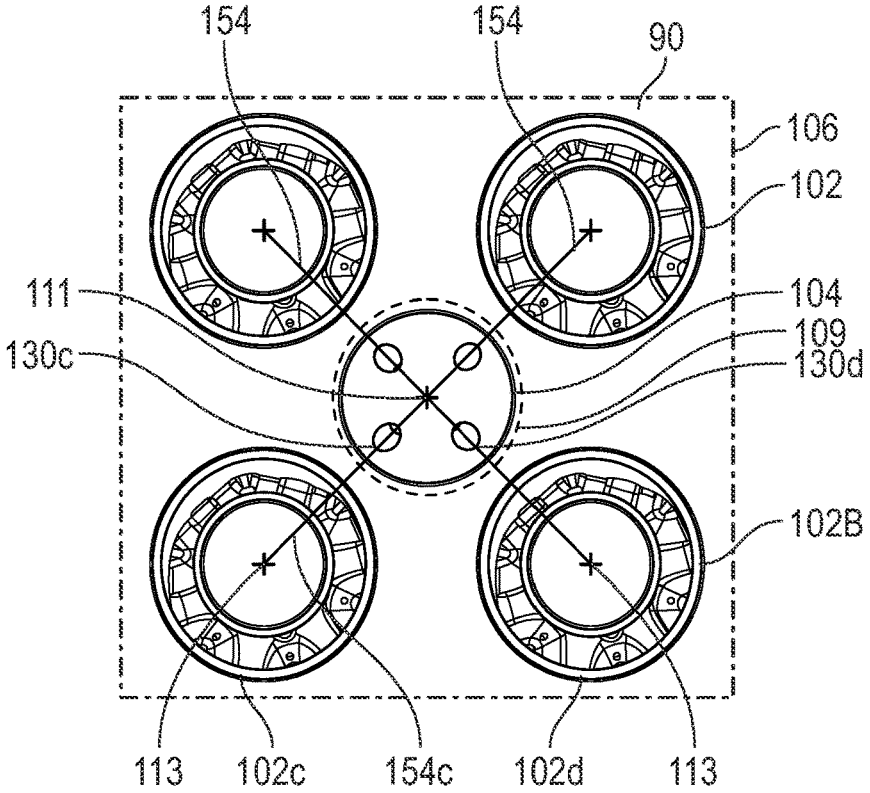
FIG. 13 is a plan view of an arrangement of main pre-mixers and a pilot pre-mixer, according to an embodiment of the present disclosure.
Figure 14:
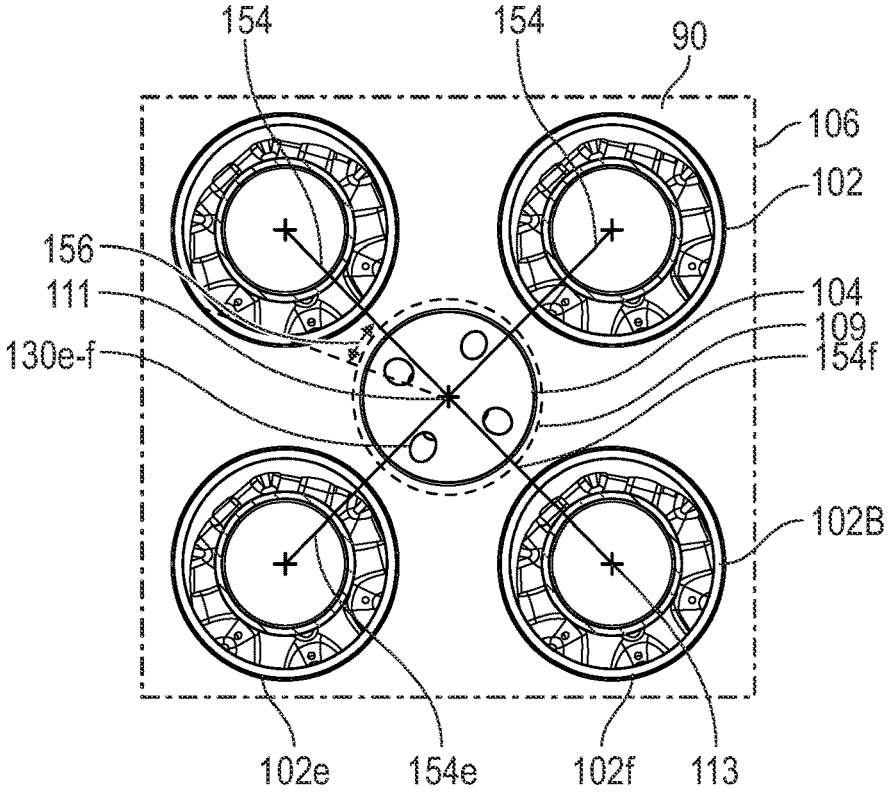
FIG. 14 is a plan view of an arrangement of main pre-mixers and a pilot pre-mixer, according to an embodiment of the present disclosure.

Referring now to FIGS. 12 to 14, various arrangements of the outlets 130 from the pilot pre-mixer 104 into the combustion chamber with respect to the main pre-mixers 102 will be described. Each of FIGS. 12 to 14 are plan views perpendicular to the combustion chamber side 90 of housing 101, and depict an arrangement of four main pre-mixers 102 (as main pre-mixer array 106) and one pilot pre-mixer 104. Of course, other arrangements can be implemented and the foregoing are merely exemplary embodiments. In the plan view of FIG. 12, outlets 130 for pilot pre-mixer 104 are seen to be arranged in a pilot pre-mixer outlet array 109, where the array in FIG. 12 constitutes four outlets 130 equally spaced about a center 111 of the pilot pre-mixer. Of course, the present disclosure is not limited to four outlets 130 or the array shown in FIG. 12, and any other arrangements could be implemented instead. In FIG. 12, a plurality of lines 150 are seen to connect a center 113 of a main pre-mixer 102 with a center 113 of another main pre-mixer 102. For example, line 150*a-b* can be seen to connect the center 113 of main pre-mixer 102*a* with the 113 center of main pre-mixer 102*b*. Another line 152 is seen to connect a center 111 of pilot pre-mixer 104 with a centerpoint 115 of each line 150. For example, line 152*a-b* can be seen to connect the center 111 of pilot pre-mixer 104 with the centerpoint 115 of line 150*a-b*. The lines 150 and 152 are utilized to demonstrate a directional alignment of outlets 130 with respect to the main pre-mixers 102. In the arrangement of FIG. 12, for the pilot pre-mixer outlet array 109 shown, a center of each of the outlets 130 are seen to be aligned along a respective line 152 such that a flow of the fuel-air mixture exiting the outlets 130 is dispersed between two respective main pre-mixers. For example, the flow from outlet 130*a* can be dispersed between main pre-mixers 102*a* and 102*b* in FIG. 12.

In the plan view of FIG. 13, a plurality of lines 154 are seen to connect a center 111 of pilot pre-mixer 104 with a center 113 of a respective main pre-mixer 102. For example, line 154*c* is seen to connect the center 111 of the pilot pre-mixer 104 with the center 113 of main pre-mixer 102*c*. In the arrangement depicted in FIG. 13, for the pilot pre-mixer outlet array 109 (same as the array 109 in FIG. 12) shown therein, a center of each of the outlets 130 is arranged to be along a respective line 154 so as to direct a flow of the fuel-air mixture toward a respective main pre-mixer 102. For example, as seen in the figure, outlet 130*c* may direct its fuel-air mixture toward main pre-mixer 102*c*, while outlet 130*d* may direct its fuel-air mixture toward man pre-mixer 102*d*.

In the plan view of FIG. 14, the alignment of lines 154 is the same as that for FIG. 13 in that each line 154 connects the center 111 of pilot pre-mixer 104 with a respective center 113 of a main pre-mixer 102. However, unlike FIG. 13 where the center of each of the outlets 130 is arranged to be on a line 154, in FIG. 14, the pilot pre-mixer 104 is rotated at an angle 156 so that, for the pilot pre-mixer outlet array 109 (same array 109 as seen in FIG. 12) shown in the figure, the center of each of the outlets 130 is skewed (offset) from the line 154 by the angle 156. In this manner, the fuel-air mixture ejected from the outlets 130 can be fed in different proportions to two main pre-mixers. For example, as seen in the figure, outlet 130*e-f* may direct a portion of its fuel-air mixture toward main pre-mixer 102*e* and may direct another portion of its fuel-air mixture toward main pre-mixer 102*f*. Since outlet 130*e-f* is arranged closer to line 154*e* than to line 154*f*, a larger percentage of the fuel-air mixture can be directed toward main pre-mixer 102*e* than is directed to main-pre-mixer 102*f*.

Figure 15:
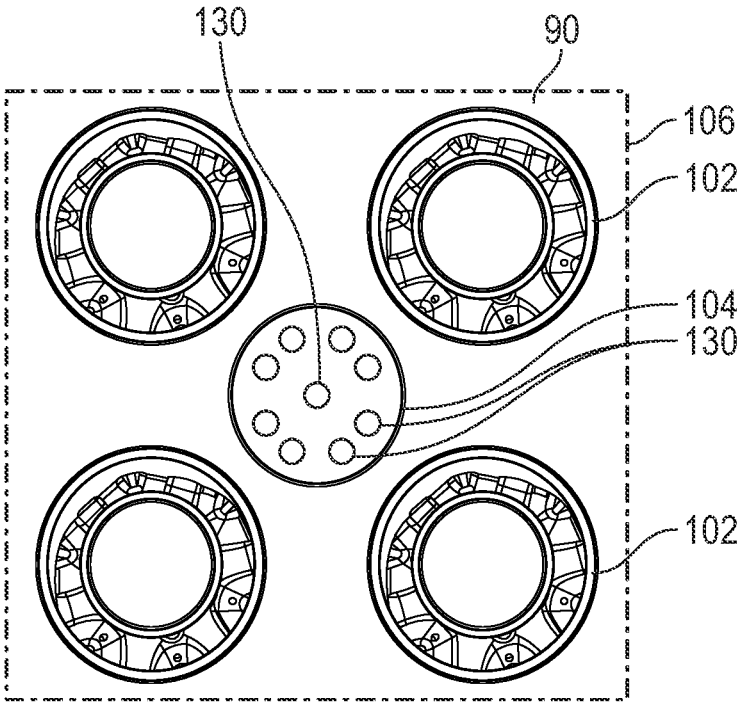
FIG. 15 is a plan view of an arrangement of main pre-mixers and a pilot pre-mixer having multiple outlets per main pre-mixer, according to an embodiment of the present disclosure.

FIG. 15 is a plan view of another arrangement of outlets 130 for a pilot pre-mixer 104 and main pre-mixers 102. In each of FIGS. 12 to 14, arrangements are depicted with a single outlet 130 for a respective main pre-mixer 102. That is, these figures depict four pilot pre-mixer outlets 130 working on conjunction with four main pre-mixers 102. In contrast, as shown in FIG. 15, the pilot pre-mixer 104 may include more than one outlet 130 for each pre-mixer. In particular, as seen in the figure, the pilot pre-mixer 104 may include two outlets 130 directing a fuel-air mixture toward a single main pre-mixer 102. The pilot pre-mixer 104 may also include a central outlet 130, providing flow generally perpendicular to the combustion chamber side 90. Of course, the present disclosure is not limited to any of these particular embodiments, and other alternative arrangements of outlets 130 and main pre-mixers may be implemented instead.

Figure 16:
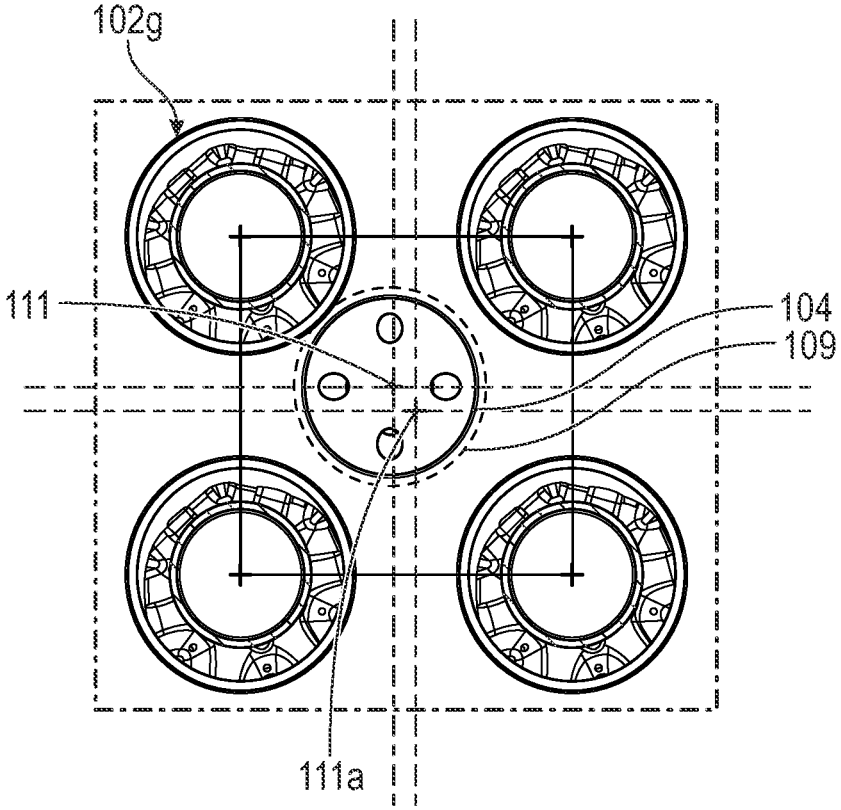
FIG. 16 is a plan view of an arrangement of main pre-mixers and an offset pilot pre-mixer, according to an embodiment of the present disclosure.

FIG. 16 depicts another arrangement of the pilot pre-mixer 104 with respect to the main pre-mixers 102 that is different from that shown in FIGS. 12 to 14. In FIGS. 12 to 14, the pilot pre-mixer 104 is seen with its center 111 centrally located with respect to each of the main pre-mixers 102 in the array 106. That is, the centers 113 of each main pre-mixer 102 are each equidistant from the center 111 of the pilot pre-mixer. For example, in FIG. 13, each of lines 154 are the same length, representing that each main pre-mixer is located the same distance from the pilot center 111. Additionally, the centers 113 of each main pre-mixer 102 are equidistant with one another in the array, where the distance from one center 113 of, for example, main pre-mixer 102*a* to another center 113 of, for example main pre-mixer 102*b*, along each of lines 150 are the same. Thus, the four main pre-mixer array 106 shown in FIGS. 12 to 14, for example, forms an array centroid that is also located at the same location as the center 111. In FIG. 16, the pilot pre-mixer 104 is shown with its center 111 shifted from being coincident with the array centroid 111*a* so that the pilot pre-mixer 104 is closer to one of the main pre-mixers 102*g*. Of course, the pilot pre-mixer 104 can be shifted away from the array centroid 111*a* in any direction and the present disclosure is not limited to the shift shown in FIG. 16. In addition, the pilot pre-mixer 104 could be both shifted as shown in FIG. 16 and rotated as shown in FIG. 14.

In the foregoing FIGS. 4 to 8, while the pilot body 110 may appear to be depicted as a single unit, it is understood that the body may be comprised of multiple component parts. For example, one component part may include an upstream portion that includes the oxidizer inlet ports 123 and conical fuel nozzle. Another component part may include a middle portion that includes the internal mixing chamber 112 and oxidizer inlet ports 122, 124 and 126. Additional component parts may comprise a downstream portion of the body that includes the pilot outlet ports 128. Each of the component parts may then be assembled together to form the pilot body 110 depicted in the drawings.

In another aspect, the present disclosure provides for a method of operating a gas turbine engine utilizing the pre-mixer assembly. More particularly, method is practiced by a gas turbine engine has a pre-mixer assembly including a plurality of main pre-mixers for dispensing a main pre-mixer fluid mixture to a combustion zone of a combustor, and at least one pilot pre-mixer having a plurality of pilot outlet ports each having an outlet for dispensing a pilot fluid mixture into the combustion zone of the combustor. According to the present disclosure, the gas turbine engine is operated by a method that provides fuel to a mixing chamber of the pilot pre-mixer, provides a flow of an oxidizer agent to the mixing chamber of the pilot pre-mixer via first oxidizer inlet ports, and mixes, in the mixing chamber the fuel and the flow of the oxidizer agent to produce a pilot fuel-oxidizer mixture. The pilot fuel-oxidizer mixture is then ejected from respective outlets of the plurality of pilot outlet ports into the combustion zone of the combustor, and in the combustion zone of the combustor, the ejected pilot fuel-oxidizer mixture is ignited to produce a plurality of pilot flames from the pilot pre-mixer. In one exemplary aspect, the pilot fuel-oxidizer mixture is directionally ejected from respective ones of the outlets toward a respective main pre-mixer in the combustor. In addition, the method further provides for ejecting a main pre-mixer fuel-oxidizer mixture from respective ones of the plurality of main pre-mixers into the combustion zone of the combustor, wherein the plurality of pilot flames are utilized as an ignition source to ignite the main pre-mixer fuel-oxidizer mixtures of the plurality of main pre-mixers in the combustion zone of the combustor.

In a further aspect of the method, the pilot pre-mixer further includes second oxidizer inlet ports arranged to provide a flow of the oxidizer agent to the mixing chamber. Here, the mixing portion of the method involves, in the pilot pre-mixer, directing the flow of the oxidizer agent from second oxidizer inlet ports along a surface of and toward a tip of a fuel injector from which the flow of the fuel is provided to the mixing chamber, and directing the flow of the oxidizer agent from the first oxidizer inlet ports toward the tip of the fuel injector, wherein the directing the flow of the oxidizer agent from the first oxidizer inlet ports and the directing of the flow of the oxidizer agent from the second oxidizer inlet ports causes a mixture of a fuel-oxidizer fluid at the tip of the fuel injector to circulate outwards toward an outer wall of the mixing chamber.

As discussed above, the pilot of the prior art provides for a low swirl of the fuel air mixture within the pilot pre-mixer, and a generally centrally concentrated flow is projected from the outlet side into the combustion chamber. Thus, the mixedness obtained by the prior art pilot is about 93%. In contrast, in the pilot pre-mixer according to the present disclosure, a non-swirled flow occurs within the pilot pre-mixer. However, additional mixing of the fuel air mixture occurs within the outlet port. At the outlets, therefore, the mixedness spreads out further from the center to mix better with the main pre-mixer flow, such that about 98% mixedness can be achieved.

Similarly, an exit flow progress variable of the fuel air mixture for the conventional low swirl pilot pre-mixer results in a centrally projected flow from the outlet into the combustion chamber and the flow then progresses into a balloon type flow. In contrast, the present disclosure has a flow progress where the fuel-air mixture at the outlet to the combustion chamber projects a smaller flow angularly directed toward the main mixer, and the progress of the flow at remains more concentrated toward the main mixer flames.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A pre-mixer assembly for a gas turbine engine, comprising, a housing having a combustion chamber side and a pre-mixer side, a plurality of main pre-mixers connected to the housing, each main pre-mixer having an outlet on the combustion chamber side of the housing for dispensing a main pre-mixer fluid mixture to a combustion zone of a combustor, and at least one pilot pre-mixer connected to the housing, wherein each pilot pre-mixer comprises, a pilot body, including: an internal mixing chamber, a first end on an upstream side of the internal mixing chamber, a second end on a downstream side of the internal mixing chamber, a fuel injector at the first end and communicable with the internal mixing chamber, a plurality of first oxidizer inlet ports arranged to provide an oxidizer agent from outside of the pilot body to the internal mixing chamber, and a plurality of pilot outlet ports at the second end and communicable with the internal mixing chamber, each of the plurality of pilot outlet ports having an outlet on the second end for dispensing a pilot fluid mixture into the combustion zone of the combustor.

The pre-mixer assembly according to any preceding clause, wherein each of the plurality of pilot outlet ports includes an angular portion arranged at an angle extending radially outward from the internal mixing chamber toward the second end.

The pre-mixer assembly according to any preceding clause, wherein an angle of the angular portion has a range of zero to 70 degrees with respect to a centerline axis of the internal mixing chamber.

The pre-mixer assembly according to any preceding clause, wherein each of the plurality of pilot outlet ports commence in the internal mixing chamber from 30 to 90% of a length extending from a tip of the fuel injector to the second end.

The pre-mixer assembly according to any preceding clause, wherein at least one of the plurality of pilot outlet ports commence in the internal mixing chamber at a length different from others of the plurality of pilot outlet ports.

The pre-mixer assembly according to any preceding clause, wherein the pilot body further comprises a plurality of second oxidizer inlet ports arranged to provide the oxidizer agent from the outside of the pilot body to the internal mixing chamber, the plurality of second oxidizer inlet ports being arranged upstream of the first oxidizer inlet ports and being at an angle extending radially inward toward a centerline axis of the internal mixing chamber from the first end toward the second end.

The pre-mixer assembly according to any preceding clause, wherein the fuel injector comprises, a conical shaped outer surface with a truncated apex thereof forming a fuel injector tip extending into the internal mixing chamber toward the second end, and a fuel outlet port arranged through the fuel injector tip, wherein at least a portion of each of the second oxidizer inlet ports is arranged to provide a flow of the oxidizer agent along the conical shaped outer surface of the fuel injector toward the fuel injector tip.

The pre-mixer assembly according to any preceding clause, wherein each of the plurality of first oxidizer inlet ports are arranged with a respective center thereof substantially aligned with the fuel injector tip.

The pre-mixer assembly according to any preceding clause, wherein, in a plan view of the combustion chamber side of the housing, a first group of main pre-mixers among the plurality of main pre-mixers are arranged in a main pre-mixer array, and wherein one pilot pre-mixer is arranged centrally within the main pre-mixer array.

The pre-mixer assembly according to any preceding clause, wherein, in a plan view of the combustion chamber side of the housing, a first group of main pre-mixers among the plurality of main pre-mixers are arranged in a first main pre-mixer array, and a second group of main pre-mixers among the plurality of main pre-mixers are arranged in a second main pre-mixer array, and wherein a first pilot pre-mixer is arranged between the first main pre-mixer array and the second main pre-mixer array.

The pre-mixer assembly according to any preceding clause, wherein, in the plan view of the combustion chamber side of the housing, the outlets of the plurality of pilot outlet ports for the one pilot pre-mixer are arranged in a pilot pre-mixer outlet array, and wherein, each respective one of the outlets in the pilot pre-mixer outlet array is arranged aligned on a respective line connecting a center of the pilot pre-mixer and a center of a respective one of the plurality of main pre-mixers in the main pre-mixer array.

The pre-mixer assembly according to any preceding clause, wherein, in the plan view of the combustion chamber side of the housing, the outlets of the plurality of pilot outlet ports for the one pilot pre-mixer are arranged in a pilot pre-mixer outlet array, and wherein, each respective one of the outlets in the pilot pre-mixer outlet array is arranged offset from a respective line connecting a center of the pilot pre-mixer and a center of a respective one of the plurality of main pre-mixers in the main pre-mixer array.

The pre-mixer assembly according to any preceding clause, wherein, in the plan view of the combustion chamber side of the housing, the outlets of the plurality of pilot outlet ports for the one pilot pre-mixer are arranged in a pilot pre-mixer outlet array, and wherein, each respective one of the outlets in the pilot pre-mixer outlet array is arranged aligned on a respective line connecting a center of the pilot pre-mixer outlet array and a respective center of a line connecting centers of two respective ones of the plurality of main pre-mixers in the main pre-mixer array.

The pre-mixer assembly according to any preceding clause, wherein at least a portion of each of the plurality of pilot outlet ports is helical in shape and, in a plan view of the combustion chamber side of the housing, each of the outlets of the plurality of pilot outlet ports provide tangential flow of the pilot fluid mixture into the combustion chamber.

Further aspects of the present disclosure are provided by the subject matter of the following further clauses.

A pilot pre-mixer for a gas turbine engine, comprising, a pilot body, including: an internal mixing chamber, a first end on an upstream side of the internal mixing chamber, a second end on a downstream side of the internal mixing chamber, a fuel injector at the first end and communicable with the internal mixing chamber, a plurality of first oxidizer inlet ports arranged to provide an oxidizer agent from outside of the pilot body to the internal mixing chamber, and a plurality of pilot outlet ports at the second end and communicable with the internal mixing chamber, each of the plurality of pilot outlet ports having an outlet on the second end for dispensing a pilot fluid mixture into a combustion zone of a combustor.

The pilot pre-mixer according to any preceding clause, wherein each of the plurality of pilot outlet ports includes an angular portion arranged at an angle extending radially outward from the internal mixing chamber toward the second end.

The pilot pre-mixer according to any preceding clause, wherein an angle of the angular portion has a range from zero to 70 degrees with respect to a centerline axis of the internal mixing chamber.

The pilot pre-mixer according to any preceding clause, wherein each of the plurality of pilot outlet ports commence in the internal mixing chamber from 30 to 90% of a length extending from a tip of the fuel injector to the second end.

The pilot pre-mixer according to any preceding clause, wherein at least one of the plurality of pilot outlet ports commence in the internal mixing chamber at a length different from others of the plurality of pilot outlet ports.

The pilot pre-mixer according to any preceding clause, wherein the pilot body further comprises a plurality of second oxidizer inlet ports arranged to provide the oxidizer agent from the outside of the pilot body to the internal mixing chamber, the plurality of second oxidizer inlet ports being arranged upstream of the first oxidizer inlet ports and being at an angle extending radially inward toward a centerline axis of the internal mixing chamber from the first end toward the second end.

The pilot pre-mixer according to any preceding clause, wherein the fuel injector comprises: a conical shaped outer surface with a truncated apex thereof forming a fuel injector tip extending into the internal mixing chamber toward the second end, and a fuel outlet port arranged through the fuel injector tip, wherein at least a portion of each of the second oxidizer inlet ports is arranged to provide a flow of the oxidizer agent along the conical shaped outer surface of the fuel injector toward the fuel injector tip.

The pilot pre-mixer according to any preceding clause, wherein each of the plurality of first oxidizer inlet ports are arranged with a respective center thereof substantially aligned with the fuel injector tip.

Further aspects of the present disclosure are provided by the subject matter of the following clauses.

A method of operating a gas turbine engine, the gas turbine engine comprising a pre-mixer assembly including a plurality of main pre-mixers for dispensing a main pre-mixer fluid mixture to a combustion zone of a combustor, and at least one pilot pre-mixer having a plurality of pilot outlet ports each having an outlet for dispensing a pilot fluid mixture into the combustion zone of the combustor, the method comprising, providing fuel to a mixing chamber of the pilot pre-mixer, providing a flow of an oxidizer agent to the mixing chamber of the pilot pre-mixer via first oxidizer inlet ports, mixing, in the mixing chamber the fuel and the flow of the oxidizer agent to produce a pilot fuel-oxidizer mixture, ejecting the pilot fuel-oxidizer mixture from respective outlets of the plurality of pilot outlet ports into the combustion zone of the combustor, and igniting, in the combustion zone of the combustor, the pilot fuel-oxidizer mixture ejected to produce a plurality of pilot flames from the pilot pre-mixer.

The method according to any preceding clause, wherein the pilot fuel-oxidizer mixture is directionally ejected from respective ones of the outlets toward a respective main pre-mixer in the combustor.

The method according to any preceding clause further comprising ejecting a main pre-mixer fuel-oxidizer mixture from respective ones of the plurality of main pre-mixers into the combustion zone of the combustor, wherein the plurality of pilot flames are utilized as an ignition source to ignite the main pre-mixer fuel-oxidizer mixtures of the plurality of main pre-mixers in the combustion zone of the combustor.

The method according to any preceding clause, wherein the pilot pre-mixer further comprises second oxidizer inlet ports arranged to provide a flow of the oxidizer agent to the mixing chamber, and wherein the mixing comprises: in the pilot pre-mixer, directing the flow of the oxidizer agent from second oxidizer inlet ports along a surface of and toward a tip of a fuel injector from which the flow of the fuel is provided to the mixing chamber; and directing the flow of the oxidizer agent from the first oxidizer inlet ports toward the tip of the fuel injector, wherein the directing the flow of the oxidizer agent from the first oxidizer inlet ports and the directing of the flow of the oxidizer agent from the second oxidizer inlet ports causes a mixture of a fuel-oxidizer fluid at the tip of the fuel injector to circulate outwards toward an outer wall of the mixing chamber.

The pre-mixer assembly according to any preceding clause, wherein the angle of the second oxidizer inlet ports ranges from 10 to less than 90 degrees.

The pre-mixer assembly according to any preceding clause, wherein, in a plan view of the combustion chamber side of the housing, the plurality of main pre-mixers are arranged in a main pre-mixer array, the plurality of main pre-mixers in the pre-mixer array defining a main pre-mixer array centroid, and wherein one pilot pre-mixer is arranged within the main pre-mixer array with a pilot center offset from the main pre-mixer array centroid.

The per-mixer assembly according to any preceding clause, wherein the plurality of pilot outlet ports comprises more than one pilot outlet port arranged for each one main pre-mixer among the plurality of pre-mixers.

Although the foregoing description is directed to the preferred embodiments of the present disclosure, it is noted that other variations and modifications will be apparent to those skilled in the art, and may be made without departing from the spirit or scope of the present disclosure. Moreover, features described in connection with one embodiment of the disclosure may be used in conjunction with other embodiments, even if not explicitly stated above.

What is claimed is:

1. A pre-mixer assembly for a gas turbine engine, comprising:

a housing having a combustion chamber side and a pre-mixer side;

a plurality of main pre-mixers connected to the housing, each main pre-mixer having an outlet on the combustion chamber side of the housing for dispensing a main pre-mixer fluid mixture to a combustion chamber of a combustor; and at least one pilot pre-mixer connected to the housing, wherein each pilot pre-mixer comprises:

a pilot body, including:

an internal mixing chamber;

a first end on an upstream side of the internal mixing chamber;

a second end on a downstream side of the internal mixing chamber;

a fuel injector at the first end and communicable with the internal mixing chamber;

a plurality of first oxidizer inlet ports arranged to provide an oxidizer agent from outside of the pilot body to the internal mixing chamber; and a plurality of pilot outlet ports at the second end and communicable with the internal mixing chamber, each of the plurality of pilot outlet ports having an outlet on the second end for dispensing a pilot pre-mixer fluid mixture into the combustion chamber of the combustor.

2. The pre-mixer assembly according to claim 1, wherein each of the plurality of pilot outlet ports includes an angular portion arranged at an angle extending radially outward from the internal mixing chamber toward the second end.

3. The pre-mixer assembly according to claim 2, wherein an angle of the angular portion has a range of zero to 70 degrees with respect to a centerline axis of the internal mixing chamber.

4. The pre-mixer assembly according to claim 1, wherein each of the plurality of pilot outlet ports commence in the internal mixing chamber from 30 to 90% of a length extending from a tip of the fuel injector to the second end.

5. The pre-mixer assembly according to claim 4, wherein at least one of the plurality of pilot outlet ports commence in the internal mixing chamber at a length different from others of the plurality of pilot outlet ports.

6. The pre-mixer assembly according to claim 1, wherein the pilot body further comprises a plurality of second oxidizer inlet ports arranged to provide the oxidizer agent from the outside of the pilot body to the internal mixing chamber, the plurality of second oxidizer inlet ports being arranged upstream of the first oxidizer inlet ports and being at an angle extending radially inward toward a centerline axis of the internal mixing chamber from the first end toward the second end.

7. The pre-mixer assembly according to claim 6, wherein the fuel injector comprises:

a conical shaped outer surface with a truncated apex thereof forming a fuel injector tip extending into the internal mixing chamber toward the second end, and a fuel outlet port arranged through the fuel injector tip, wherein at least a portion of each of the second oxidizer inlet ports is arranged to provide a flow of the oxidizer agent along the conical shaped outer surface of the fuel injector toward the fuel injector tip.

8. The pre-mixer assembly according to claim 7, wherein each of the plurality of first oxidizer inlet ports are arranged with a respective center thereof substantially aligned with the fuel injector tip.

9. The pre-mixer assembly according to claim 1, wherein, in a plan view of the combustion chamber side of the housing, a first group of main pre-mixers among the plurality of main pre-mixers are arranged in a main pre-mixer array, and wherein one pilot pre-mixer is arranged centrally within the main pre-mixer array.

10. The pre-mixer assembly according to claim 1, wherein, in a plan view of the combustion chamber side of the housing, a first group of main pre-mixers among the plurality of main pre-mixers are arranged in a first main pre-mixer array, and a second group of main pre-mixers among the plurality of main pre-mixers are arranged in a second main pre-mixer array, and wherein a pilot pre-mixer is arranged between the first main pre-mixer array and the second main pre-mixer array.

11. The pre-mixer assembly according to claim 9, wherein, in the plan view of the combustion chamber side of the housing, the outlets of the plurality of pilot outlet ports for the one pilot pre-mixer are arranged in a pilot pre-mixer outlet array, and wherein, each respective one of the outlets in the pilot pre-mixer outlet array is arranged aligned on a respective line connecting a center of the pilot pre-mixer and a center of a respective one of the plurality of main pre-mixers in the main pre-mixer array.

12. The pre-mixer assembly according to claim 9, wherein, in the plan view of the combustion chamber side of the housing, the outlets of the plurality of pilot outlet ports for the one pilot pre-mixer are arranged in a pilot pre-mixer outlet array, and wherein, each respective one of the outlets in the pilot pre-mixer outlet array is arranged offset from a respective line connecting a center of the pilot pre-mixer and a center of a respective one of the plurality of main pre-mixers in the main pre-mixer array.

13. The pre-mixer assembly according to claim 9, wherein, in the plan view of the combustion chamber side of the housing, the outlets of the plurality of pilot outlet ports for the one pilot pre-mixer are arranged in a pilot pre-mixer outlet array, and wherein, each respective one of the outlets in the pilot pre-mixer outlet array is arranged aligned on a respective line connecting a center of the pilot pre-mixer outlet array and a respective center of a line connecting centers of two respective ones of the plurality of main pre-mixers in the main pre-mixer array.

14. A pilot pre-mixer for a gas turbine engine, comprising:

a pilot body, including:

an internal mixing chamber;

a first end on an upstream side of the internal mixing chamber;

a second end on a downstream side of the internal mixing chamber;

a fuel injector at the first end and communicable with the internal mixing chamber;

a plurality of first oxidizer inlet ports arranged to provide an oxidizer agent from outside of the pilot body to the internal mixing chamber; and a plurality of pilot outlet ports at the second end and communicable with the internal mixing chamber, each of the plurality of pilot outlet ports having an outlet on the second end for dispensing a pilot fluid mixture into a combustion zone of a combustor.

15. The pilot pre-mixer according to claim 14, wherein each of the plurality of pilot outlet ports includes an angular portion arranged at an angle extending radially outward from the internal mixing chamber toward the second end.

16. The pilot pre-mixer according to claim 15, wherein the angle of the angular portion has a range from zero to 70 degrees with respect to a centerline axis of the internal mixing chamber.

17. The pilot pre-mixer according to claim 14, wherein each of the plurality of pilot outlet ports commence in the internal mixing chamber from 30 to 90% of a length extending from a tip of the fuel injector to the second end.

18. The pilot pre-mixer according to claim 17, wherein at least one of the plurality of pilot outlet ports commence in the internal mixing chamber at a length different from others of the plurality of pilot outlet ports.

19. The pilot pre-mixer according to claim 14, wherein the pilot body further comprises a plurality of second oxidizer inlet ports arranged to provide the oxidizer agent from the outside of the pilot body to the internal mixing chamber, the plurality of second oxidizer inlet ports being arranged upstream of the first oxidizer inlet ports and being at an angle extending radially inward toward a centerline axis of the internal mixing chamber from the first end toward the second end.

20. The pilot pre-mixer according to claim 19, wherein the fuel injector comprises:

a conical shaped outer surface with a truncated apex thereof forming a fuel injector tip extending into the internal mixing chamber toward the second end, and a fuel outlet port arranged through the fuel injector tip, wherein at least a portion of each of the second oxidizer inlet ports is arranged to provide a flow of the oxidizer agent along the conical shaped outer surface of the fuel injector toward the fuel injector tip.

* * * * *